United States Patent [19]

Lautenschläger et al.

[11] 4,347,644

[45] Sep. 7, 1982

[54] OVER-CENTER SELF CLOSING HINGE

[75] Inventors: Karl Lautenschläger, Reinheim; Gerhard W. Lautenschläger, Brensbach-Wersau, both of Fed. Rep. of Germany

[73] Assignee: Karl Lautenschläger KG Möbelbeschlagfabrik, Reinheim, Fed. Rep. of Germany

[21] Appl. No.: 217,557

[22] Filed: Dec. 17, 1980

[30] Foreign Application Priority Data

Dec. 22, 1979 [DE] Fed. Rep. of Germany ..... 2951986

[51] Int. Cl.[3] ..... E05D 11/10

[52] U.S. Cl. ..... 16/50; 16/294; 16/333

[58] Field of Search ..... 16/183, 50, 189, 182, 16/164, 165, 294, 370, 379, 333

[56] References Cited

U.S. PATENT DOCUMENTS

| | | | |
|---|---|---|---|
| 2,149,973 | 3/1939 | Ludwig | 16/164 |
| 3,590,420 | 7/1971 | Salice | 16/164 |
| 4,112,543 | 9/1978 | Rock et al. | 16/164 |
| 4,114,237 | 9/1978 | Grass | 16/164 X |
| 4,190,925 | 3/1980 | Kavusalo | 16/50 X |

*Primary Examiner*—Werner H. Schroeder
*Assistant Examiner*—Andrew M. Falik

[57] ABSTRACT

Over-center hinge for cabinet doors, having a door-related part in the form of a recess-mounted cup in which the ends of inner and outer links are pivotingly mounted whose outer ends are pivoted on a supporting-wall-related part in the form of a supporting arm, a pressure piece biased by a spring being pivotingly mounted within the supporting arm on the inner link nearest the supporting wall and bearing against a counter-surface which during the hinge movement undergoes a change of position relative to the pressure piece such that the hinge, after passing beyond a dead center during the closing movement, is resiliently forced into the closed position. The spring is a torsion coil spring whose one arm bears against the inner link and whose other arm bears against the pressure piece, and which spring is held by a pin which is provided at a distance above the pivot eye of the inner link and which passes through the coils of the torsion coil spring, and whose ends are fastened each in a bore in each of the ears formed on and bent up from opposite longitudinal sides of the inner link. The configuration is such that the free ends of the arms of the torsion coil spring point out of the supporting arm toward the door-related hinge part.

5 Claims, 6 Drawing Figures

FIG.3
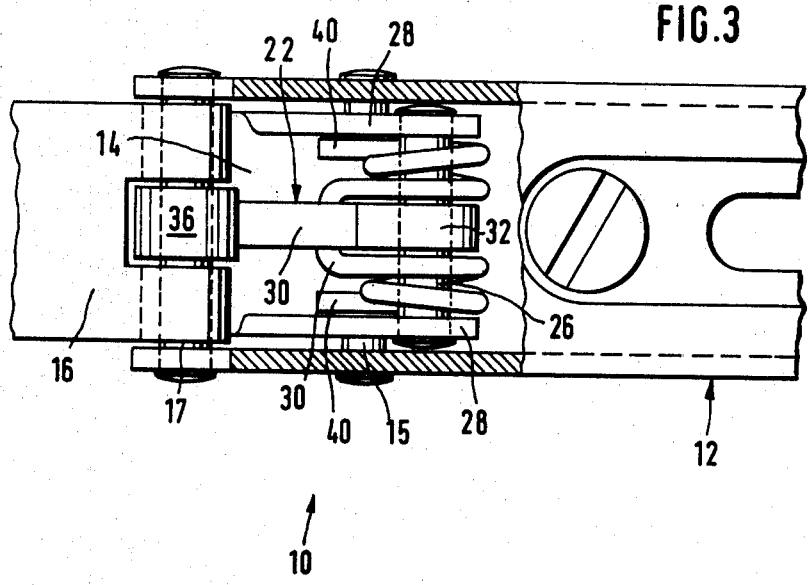
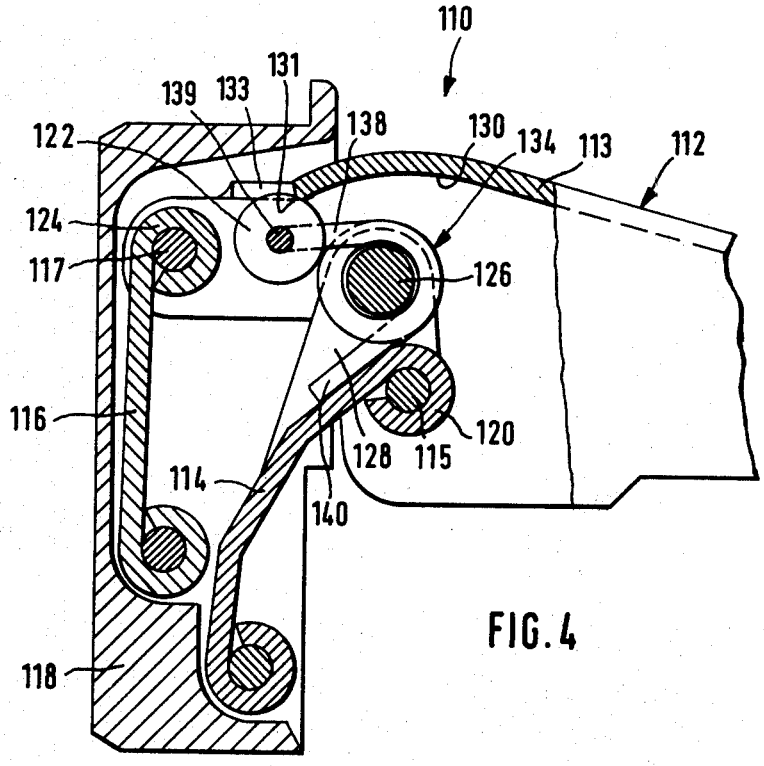
FIG.4

OVER-CENTER SELF CLOSING HINGE

BACKGROUND

The invention relates to an over-center hinge for cabinet doors which has a door-related part in the form of a cup designed for installation in a mortise, in which are pivotingly mounted the ends of two hinge links whose other ends are mounted on the supporting-wall-related part in the form of a supporting arm thereby creating a four-pivot linkage. A pressure piece biased by a spring is pivoted within the supporting arm on the inner hinge link nearer to the supporting wall and bears against a surface which undergoes a change of position relative to the pressure piece upon the movement of the hinge, such that the hinge is resiliently urged into the closed position upon passing over a dead center in the closing movement.

Over-center hinges, in which the over-center mechanism is situated substantially out of sight in the interior of the supporting arm, are known, the configuration being such, for example, that the pressure piece is a roller mounted on a spring-biased lever or bridle pivoted in the support arm and cooperates with a surface formed on or attached to one of the links (German AS No. 1,708,227, U.S. Pat. No. 3,590,420). In addition to the relatively great complexity of design of these hinges and the consequently high cost of their manufacture, space availability problems are encountered. This is because the interior of the supporting arm of such a hinge must be kept largely free to accommodate the fastening and adjustment means whereby provision is made for fastening the supporting arm to the mounting plate provided on the supporting wall of the cabinet and for the necessary adjustment or alignment of the hinge. In the known hinges, this space is diminished by the bridle holding the pressure roller and by the spring. In an over-center hinge of the kind mentioned in the beginning (German OS No. 2,516,084), the attempt has therefore been made to shift the over-center mechanism toward the forward supporting arm end facing the door-related part of the hinge, in order thus to obtain more space for the fastening and adjusting means within the supporting arm. The over-center mechanism is formed by a plastic pressure piece pivotingly attached in the middle portion of the inner hinge link with its free end pointing toward the interior of the supporting arm; this pressure piece is biased by a helical spring bearing against the pressure piece at one end and against the pivot pin in the eye of the supporting-wall end of the inner link at the other, thereby urging a projection on the supporting-arm end of the pressure piece against the inner surface of the transverse wall of the upper supporting arm when the hinge is in the open state. When the hinge swings from the open to the closed position, the actual bearing surface of the pressure piece gradually approaches the eye at the supporting arm end of the outer hinge link. During the last portion of the closing movement, this bearing surface slides on the pivot eye, thereby slightly increasing the spring bias. Shortly before the closed position is reached, the bearing surface is then shaped such that the helical spring exerts a closing torque on the hinge, which draws the door mounted by the hinge resiliently to the closed position and holds it there. The known hinge is completely functional, but as far as the desired saving of space inside of the supporting arm is concerned it falls short of the optimum, because the pressure piece projection which in the area of the hinge-open position points to the interior of the supporting arm and bears against the supporting arm interferes with the provision of an adjusting screw in the area of the projection.

THE INVENTION

It is the object of the invention, on the other hand, to further improve the known hinge with regard to the space required for the over-center mechanism in the interior of the supporting arm, while at the same time making the initiation of the closing torque of the over-center mechanism more precise.

Setting out from an over-center hinge of the kind described in the beginning, this problem is solved by the invention by the fact that the spring is a torsion coil spring which has one arm bearing against the inner link and the other arm bearing against the pressure piece. The spring is held by a pin which is provided at a distance above the eye at the supporting-arm end of the inner link and passes through the coils of the torsion coils spring, and has its ends fastened in bores in ears formed by bending up the opposite longitudinal sides of the inner link, the arrangement being made such that the free ends of the arms of the torsion coil spring point away from the supporting arm towards the door-related part of the hinge.

In one advantageous embodiment of the invention, the design is such that the pressure piece is mounted pivotingly on the pin holding the torsion coil spring, can pivot toward the eye at the supporting-arm end of the outer link, and, with a bearing surface adjacent this pivot eye, bears against the counter-surface. The bearing surface of the pressure piece is composed of a section that is arcuately curved concentrically with the pivot axis at the supporting-arm end of the inner link and of an adjoining section sloping away toward the pivot eye at the supporting-arm end of the inner link, the configuration is such that, during the greater portion of the movement of the hinge from the open position to the closed position, the counter-surface bears against the arcuately curved section, and just before the hinge reaches the closed position passes over onto the sloping section of the surface. During the cooperation of the arcuate surface portion concentric with the eye at the supporting wall end of the inner hinge link with the counter-surface, no closing or opening torque is applied to the inner hinge link and hence to the hinge, because the bias of the spring in this area acts directly on the line connecting the link eye to the point of contact between the surface section and the counter-surface, i.e., no leverage is available for the building up of a torque. Not until the moment in which the counter-surface passes onto the sloping surface portion does not force of contact between the pressure piece and the counter-surface, which is deflected from the direction of action of the spring bias, initiate the closing torque, without the need, as in the case of other over-center mechanisms, of first overcoming a torque in the direction of opening.

Preferably, the torsion coil spring is a double spring, whose center loop engages the pressure piece, while the two outer arms bear against the inner link. This makes possible a symmetrical arrangement of the double torsion coil spring with torsion spring windings provided on both sides of the centrally disposed pressure piece, and this makes possible the installation of a sufficiently high spring force without producing transverse forces on the pressure piece or inner link.

The counter-surface cooperating with the bearing surface of the pressure piece is best formed by the circumferential surface of a roller mounted on the supporting arm, for the purpose of reducing the effect of sliding friction between the bearing surface and the counter-surface. To save space, the roller is best disposed such that its axis of rotation coincides with the pivot axis at the supporting-arm end of the outer link, i.e., that the pin mounting the supporting arm end of the outer link serves simultaneously for the mounting of the roller.

The roller can therefore be disposed in a central cut-out in the eye at the supporting wall end of the outer hinge link, or, alternatively, the mounting of the outer hinge link to the supporting arm can be accomplished by means of bores in lateral ears formed by bending the link, in which case there will be sufficient space between these ears for the mounting of the roller.

Alternatively, the hinge of the invention can also be designed such that the pressure piece is in the form of a roller mounted on the end of the corresponding arm of the torsion coil spring, which is urged by the spring arm that bears it against the inner surface of the upper transverse wall of the supporting arm forming the counter-surface. The area of the inner surface of the supporting arm transverse wall traversed by the roller during the hinge movement from the one end position of the hinge to the other is arcuately curved substantially concentrically with the pivot axis at the supporting-arm end of the inner link. However, it has in the transverse wall area cooperating with the roller in the immediate vicinity of the hinge closed position a transverse edge over which the roller passes shortly before the hinge reaches its closed position, in which case the transverse edge can be formed by the edge defining a cut-out in the transverse wall of the supporting arm or also in a recess pressed into the transverse wall.

In this embodiment, too, the torsion coil spring is preferably in the form of a double torsion coil spring in order to achieve a symmetrical loading of the hinge parts by the bias of the spring. The configuration is then made such that the torsion coil spring is a double torsion coil spring whose two outer arms bear against the inner link while the roller is mounted on the transverse portion of the spring wire which joins the two ends of the middle arms to form a double arm.

The invention is further explained in the following description of two embodiments in conjunction with the drawing wherein:

FIG. 3 is a partially cut-away view as seen in the direction of arrow 3 in FIG. 2;

FIG. 4 is a longitudinal central section through the hinge linkage, the door-related part of the hinge, and the linkage end of the supporting arm of a second embodiment of an over-center hinge of the invention, again in the closed position;

Figure 1:
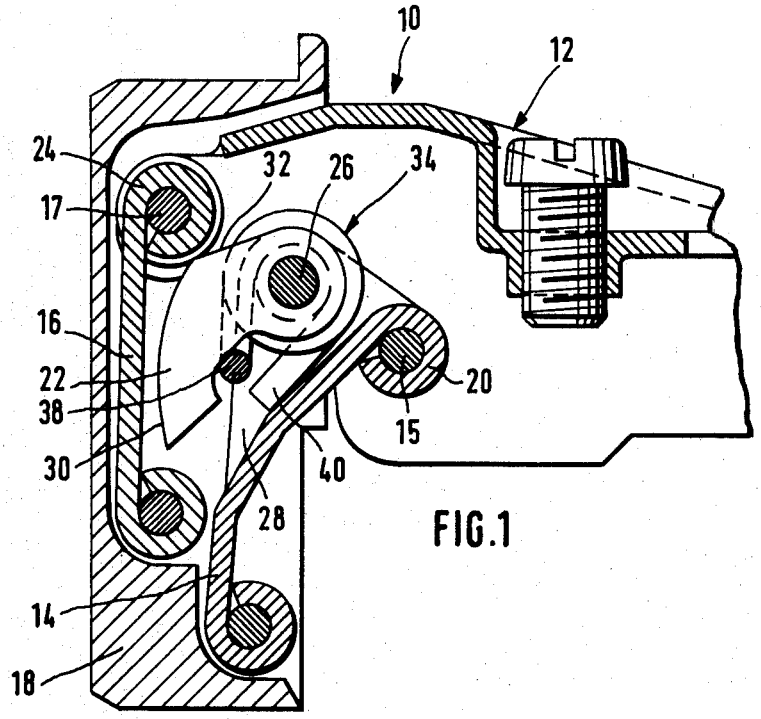
FIG. 1 is a longitudinal central cross section through the hinge linkage, the door-related hinge part and the linkage end of the supporting arm of a first embodiment of an over-center hinge of the invention, the hinge being shown in the closed position.
Figure 2:
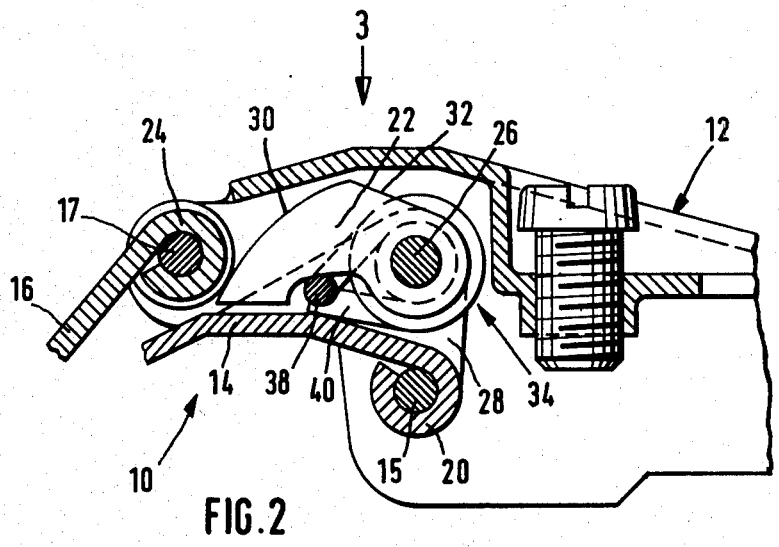
FIG. 2 is a cross-sectional view corresponding to FIG. 1, taken through the hinge in the open position, the door-related part being omitted.

In FIGS. 1 to 3 there is shown an over-center hinge of the invention designated as a whole by the number 10. The hinge 10 has, in the prior-art manner, a supporting arm 12 intended for fastening to the supporting wall of a cabinet, of which the figures in the drawing represent only the front portion containing the over-center mechanism. A shorter inner and a longer outer link 14 and 16, respectively, are pivoted on pins 15 and 17, respectively, and their other ends are pivoted in a cup 18 forming the door-related part of the hinge. The supporting arm is thus connected to the cup by a four-pivot linkage. To this extent, hinge 10 corresponds to known hinges.

The over-center mechanism of the invention consists of an elongated pressure piece 22 which is pivotingly supported at the supporting-arm end of the inner link 14, at a distance away from the pivot eye 20, and engages the pivot eye 24 at the supporting-arm end of the outer link 16, and is still in engagement with the pivot eye 24 when the hinge is in the open position (FIG. 2).

The pressure piece end within the support arm is pivotingly mounted on a pivot pin 26 whose extremities in turn are held in two ears 28 of the material of the link, which are formed on opposite longitudinal sides of the inner link 14. The pressure piece 22 has a bearing surface divided into two sections 30 and 32, of which the section 30 farther removed from the pin 26 is arcuately defined in the side view and, when in engagement with the counter-surface to be described below, is concentric with the pivot axis at the supporting arm end of the inner link 14. The second section 32, on the other hand, slopes back toward the pivot eye 20 at the supporting arm end. The pressure piece 22 is urged by a double torsion coil spring 34 against the counter-surface, which could basically be formed by the pivot eye 24 at the supporting arm end of the outer link 16. However, since the pressure piece 22 is made of relatively thin metal, i.e., the surface sections 30 and 32 are of a relatively narrow width, a roller 36 is mounted for rotation on the pivot pin 17 in a cut-out in the pivot eye 24. The counter-surface, therefore, is formed by the circumferential surface of the roller 36. Wear due to sliding contact is thus prevented.

The coils of the torsion spring are situated half on each side of the pressure piece 22, the pin 26 which passes through the coils holding the spring 34 in place. The middle loop 38 of the torsion spring 34 engages the edge of the pressure piece opposite the bearing surfaces or edges 30 and 32, and biases the pressure piece against the roller 36. The two outer arms 40 of the coil spring 34, on the other hand, bear against the inner link 14, the ears 28 serving the additional purpose of preventing these arms 40 from slipping laterally off of the inner link 14.

It can be seen in FIGS. 1 and 2 that the surface section 30 of the pressure piece, which is coaxial with the pivot axis at the supporting arm end of the inner link 14 and therefore produces no torque when it engages the counter-surface, engages the roller 36 during most of the swinging movement of the hinge. Therefore, in this portion of the movement, a door equipped with the hinge 10 of the invention can be swung in either direction in a substantially effortless manner. Not until the door is in the immediate vicinity of the closed position does the roller 36 pass over onto the surface section 32 (FIG. 1), so that then the desired closing torque develops, which draws the door to the closed position and holds it securely shut.

It is evident that the characteristic of the over-center mechanism can be varied by varying the configuration of the bearing surface of the pressure piece. If, for example, a characteristic is desired in which a door equipped with the hinge is additionally to be held in the fully open position under a certain bias, this is easily possible by making the surface section 30 depart from the arcuate form in the portion that engages the roller 36 in the fully open position. If necessary or desirable, detents in intermediate positions can also be created by providing shallow indentations at the corresponding points on the surface section 30.

Figure 5:
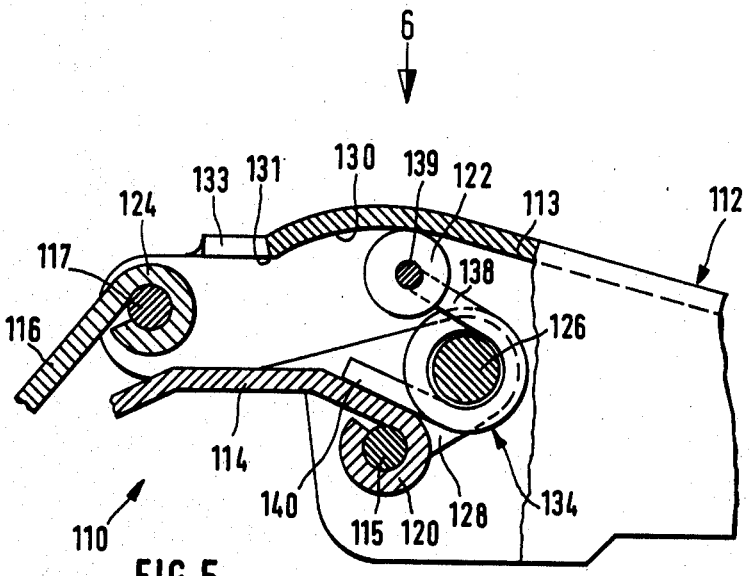
FIG. 5 is a cross-sectional view corresponding to FIG. 4, of the hinge in the open position, the door-related part being omitted.
Figure 6:
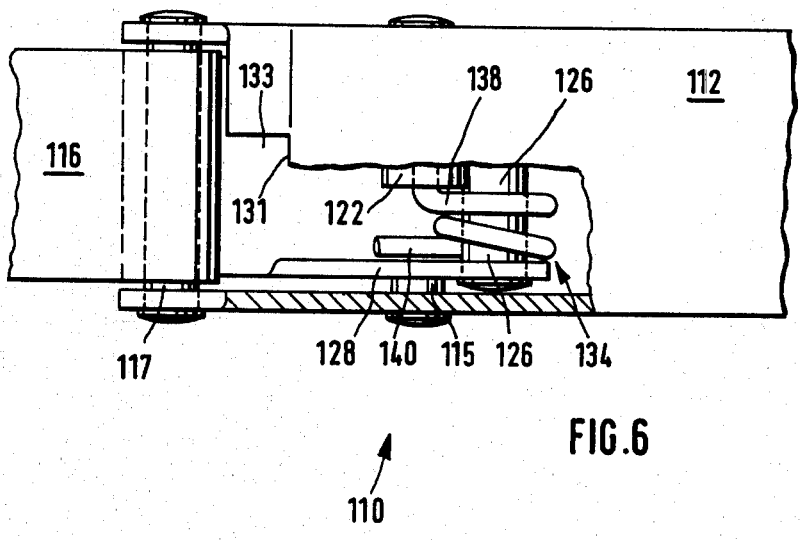
FIG. 6 is a partially cut-away view as seen in the direction of arrow 6 in FIG. 5.

In the modified over-center hinge 110 shown in FIGS. 4 to 6, identical parts are given the same reference numbers as in the case of hinge 10 in FIGS. 1 and 3, but with the prefix 1, so that it will suffice in the following description to state briefly what the differences are, while referring to the description of hinge 10 with regard to what is the same.

The pressure piece in the form of a roller 122 in this case is mounted for rotation on the spring wire section 139 joining together the free ends of the two middle arms of the torsion coil springs 134 to form a double arm 138, and is biased by the double arm 138 against the inner surface of the upper transverse wall 113 of the supporting arm 112, which is arcuately curved approximately concentrically with the pivot axis at the supporting-arm end of the inner link 114 in the area over which the roller 122 passes in the movement of the hinge from the fully open position (FIG. 5) to the final closed position (FIG. 4). Shortly before the closed position is reached, the arcuately defined area 130 of the inner surface terminates at a transverse edge 131 which is formed by a cutout 133 in the upper transverse wall 113 of the supporting arm 112. When the roller 122 passes over this edge 113, it is resiliently forced into the cutout 133, catches on the transverse edge 113, and is thus held in the closed position. Vice versa, when the hinge is to be turned back again to the open position, the roller 122 must first be moved against the spring bias exerted by the double arm 138 into the arcuate area 130. Since this area is concentric with the pivot axis at the supporting arm end of the inner link 114, i.e., the spring force of the torsion coil spring is not applied with leverage with respect to this pivot axis, no torque acts on the inner link 114, and the hinge can therefore be turned in a substantially effortless manner to the open position.

It can be seen that the over-center characteristic is also variable in the case of this hinge 110. If, for example, a characteristic is desired in which a door equipped with the hinge is additionally to be held in the fully open position under a certain tension, this can be accomplished by providing a transverse edge corresponding to the transverse edge 131 in the end section of area 130 over which the roller passes in the final open position of the hinge. This can be done, for example, by punching an opening or pressing an indentation corresponding to the cutout 133, in the transverse wall 113.

It can be seen that a variety of modifications and developments of the embodiments described can be made within the scope of the invention. The important thing in any case, however, is that the pressure piece and the counter-surface cooperating with it occupy the space within the supporting arm only in the frontmost portion thereof, so that the entire rear area of the supporting arm is available to accommodate the fastening and adjusting means.

We claim:

1. An over-center hinge for a cabinet door, said hinge having a supporting-wall related part in the form of a supporting arm, and a door-related part in the form of a cup adapted to be mounted in a recess in the door, a first link and a second link, each having first ends pivotingly mounted in said cup and second ends with pivot eyes pivoted on said supporting-wall-related part so as to form a four-pivot linkage, a roller rotatably mounted in said supporting arm, a pressure piece biased by a spring and pivotingly mounted in said supporting arm at said second link and bearing against a counter-surface which during the hinge movement undergoes a change of position relative to the pressure piece such that the hinge, after passing beyond a dead center during the closing movement, is resiliently forced into the closed position, said counter-surface being formed by the circumferential surface of said roller, said spring being a torsion spring with coils and two arms ending in free ends, one arm bearing against said second link and the other arm bearing against said pressure piece, a pin holding said spring, said pin being provided at a distance above said pivot eye of said second link and passing through said coils of said torsion spring, and having two ends respectively held in ears formed on and bent up from opposite longitudinal sides of said second link, the configuration being such that said free ends point out of the supporting arm toward the door-related part.

2. An over-center hinge according to claim 1, wherein said pressure piece is pivotingly mounted on said pin and has a front end pointing toward said pivot eye of said first link, and having a bearing surface adjacent said pivot eye of said first link which bears against said counter-surface, said bearing surface of said pressure piece including a first surface section which is arcuately curved coaxially to the pivot axis of the second end of said second link and a second surface section adjoining said first surface section and which slopes back toward said pivot eye of said second link, the configuration being such that the counter-surface bears against the arcuately curved first surface section during the greatest part of the hinge movement from its open position to its closed position, and just before the hinge-closed position passes over onto the turned-in second surface section.

3. An over-center hinge according to claim 2, wherein said torsion coil spring is a double torsion coil spring with a central double arm which engages said pressure piece while said arms ending in free ends are outer arms bearing against said second link.

4. An over-center hinge according to claim 1, wherein the axis of rotation of said roller coincides with the pivot axis of the second end of said first link.

5. An over-center hinge according to claim 4, wherein said roller is mounted on a pivot pin in a central cut-out of said pivot eye of the second end of said first link.

* * * * *